United States Patent [19]

Shorette

[11] 4,075,775

[45] Feb. 28, 1978

[54] LIGHT DIFFUSER AND ILLUMINATING CEILING DISPLAY

[76] Inventor: Richard A. Shorette, Crest Road, Monson, Mass. 01057

[21] Appl. No.: 700,221

[22] Filed: Jun. 28, 1976

Related U.S. Application Data

[63] Continuation-in-part of Ser. No. 530,985, Dec. 9, 1974, abandoned.

[51] Int. Cl.[2] ..... G09F 13/00

[52] U.S. Cl. ..... 40/553; 40/559; 362/150

[58] Field of Search ..... 240/2 AD, 9 R, 46.59, 240/51.11 R; 340/334, 343, 344; 40/130 R, 130 C, 132 R, 128, 132 D, 131 R, 131 A

[56] References Cited

U.S. PATENT DOCUMENTS

| | | | |
|---|---|---|---|
| 1,780,373 | 11/1930 | Beuttell | 40/130 C |
| 3,352,071 | 11/1967 | Sutter | 240/9 R X |
| 3,355,583 | 11/1967 | Sellenraad et al. | 240/51.11 R X |

FOREIGN PATENT DOCUMENTS

| | | | |
|---|---|---|---|
| 221,644 | 12/1957 | Australia | 40/131 R |
| 1,245,305 | 9/1960 | France | 40/132 R |

*Primary Examiner*—John F. Pitrelli
*Attorney, Agent, or Firm*—Chapin, Neal and Dempsey

[57] ABSTRACT

Light diffuser and illuminating ceiling display fixture for use in combination with a suspended ceiling which is in the form of an integral body of translucent, synthetic plastic sheet material. The integral body is hollow, has an open top and includes an outwardly extending annular rim. The outer dimension of the rim is approximately the same as the distance between upright web portions of adjacent, parallel ceiling title support bars. The rim is severable for supportive engagement with support members of varying spacing and the translucent body is resiliently flexible, enabling substantial deformation for fitting the fixture into an opening defined by a rectangular arrangement of ceiling support bars.

1 Claim, 3 Drawing Figures

LIGHT DIFFUSER AND ILLUMINATING CEILING DISPLAY

This application is a continuation-in-part of my earlier application Ser. No. 530,985, filed Dec. 9, 1974, entitled "Light Saving Sign", now abandoned.

BACKGROUND

In most modern retain stores, such as department stores, super markets, cut-rate drug stores and the like, a wide variety of different products are displayed frequently on a single level of large area and there is a very real need for highly visible display signs to enable the customer to visually ascertain the location of a particular product line. Of course, there is the fundamental necessity of providing for sufficient environmental lighting for effective display of the various products and for lighting the product location signs incidental to the display thereof. In recent years fluorescent lighting fixtures of various types have almost invariably been used in conjunction with suspended acoustic tile ceilings. Such fluorescent tubes are mounted in fixtures disposed above the plane of the suspended ceiling and at these locations the ceiling tiles are omitted. A translucent diffuser or lens is substituted for these tiles and is generally made flush with the ceiling. In must such stores there is usually no interrelationship between the environmental lighting fixtures and the display signs which designate the product locations. Invariably, these display signs are entirely separate and distinct from the store lighting and they are not generally illuminated. Usually they are mounted on the ceiling or the product display cases and sometimes are standing floor signs. Occasionally, individually illuminated display signs are used, but these are generally separate installations entirely independent of the regular store lighting and thus require separate wiring and additional light fixtures. This results in substantially increased electrical consumption.

The principal object of this invention is to provide low cost, convenient and easy-to-install environmental lighting and informational display fixtures wherein the same light source is utilized for both environmental lighting and for internal illumination of visual displays.

It is a further object of this invention to provide a combination light diffuser and illuminated visual display which is in the form of an integral translucent body.

It is a further object of this invention to provide an integral, hollow translucent body of the above type which is resiliently flexible and includes a severable annular rim portion for engagement with the ceiling support bars of a suspended ceiling.

The above and other objects of this invention will be more readily apparent from the following description and with reference to the accompanying drawings, in which.

Figure 1:
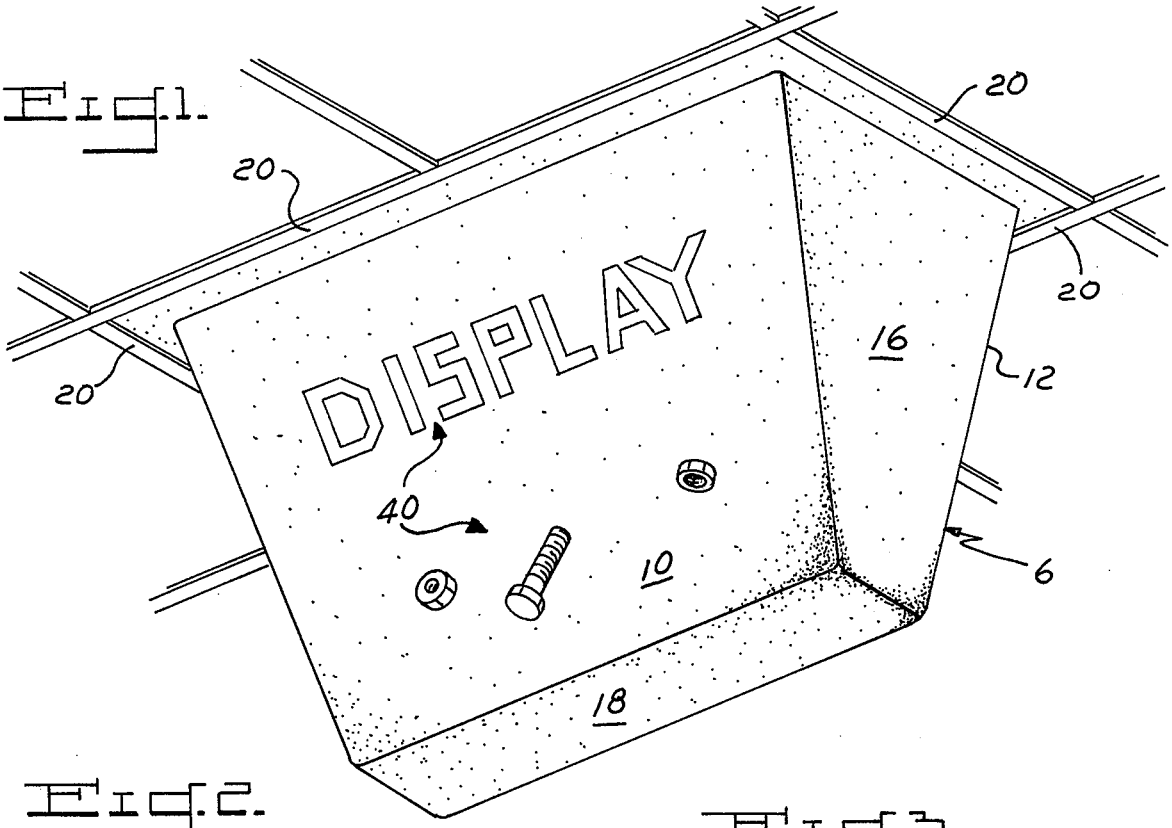
FIG. 1 is a perspective view of a light diffuser and illuminated visual display embodying this invention.

Referring in detail to the drawings, an integral translucent fixture embodying this invention is shown generally at 6. In the embodiment shown, the fixture is generally trough-shaped in taking the form of an inverted truncated pyramid with an opening 8 in the top thereof.

A peripheral or annular flange or rim 9 extends outwardly of the upper ends of the side wall portions 10 and 12 and the end wall portions 14 and 16 of the fixture. Each of the wall portions of the fixture extend downwardly and are inclined inwardly toward the opposite wall portion and terminate in a bottom wall portion 18 which is at a substantial distance below the flange 9 to provide a relatively large surface area for diffusion of maximum illumination through the translucent fixture to the surrounding area. In addition, the wall portions of the fixture provide relatively large areas for accommodating the application of visual displays, such as product identity and advertising indicia.

Figure 2:
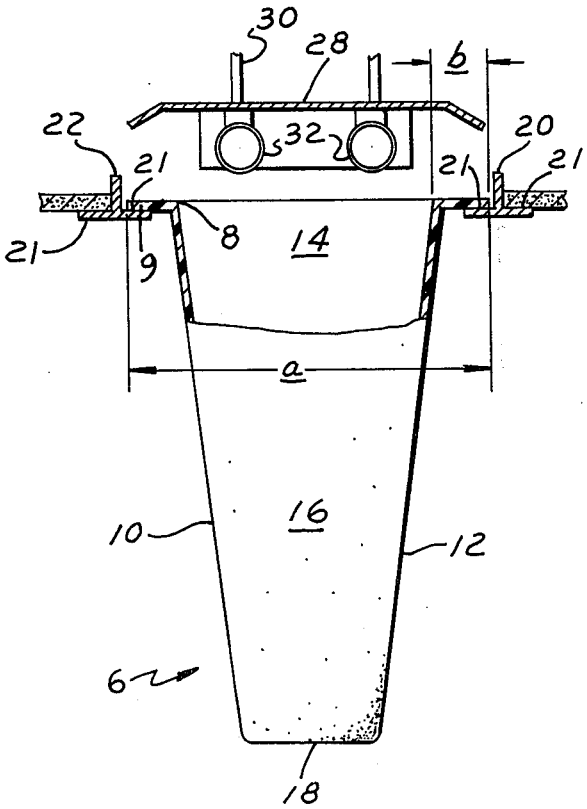
FIG. 2 is a cross sectional view of the diffuser shown in FIG. 1 mounted in a suspended ceiling.

A flange or rim 9 extends outwardly of the upper end of each of the wall portions of the fixture a substantial distance so as to provide mounting and support means for the fixture by its supportive engagement with the horizontal flanges of a ceiling support bar, such as shown at 20 in FIG. 2. The support bar shown is generally of T shape configuration and includes a generally horizontal flange portion 21 on opposite sides of an upright web portion 22. The outer dimension *a* of the fixture, measured transversely from edge-to-edge of the oppositely disposed rims, is approximately equal to the distance beteen upright web portions 22 of parallel, adjacent support bars conventionally used in suspended type ceiling installations, as shown in FIG. 2. The cross sectional configuration of the fixture parallel to the rim 9 may be either square or of elongated rectangular configuration, depending upon the type of support structure used in the particular ceiling installation. In many such ceiling installations, acoustic tiles supported by rectangularly arranged T bars are on the order of 2 feet square. It has been found that by making the dimension *a* of the integral fixture approximately $23\frac{7}{8}$ inches, that the fixture will be supportively engaged by the flange portions 21 of four rectangularly disposed ceiling support bars 22.

Figure 3:
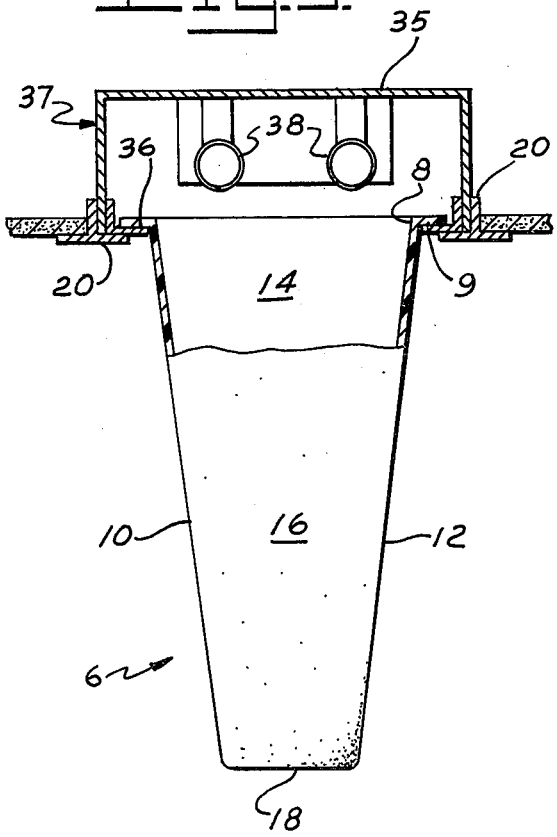
FIG. 3 is a view similar to FIG. 2 in which the diffuser is fitted into a light fixture installed in the suspended ceiling.

The width *b* of the annular rim 9 is made sufficiently large so as to be substantially greater than the width of one flange portion 21 of the T bar. This dimensional relationship of the fixture relative to the flanges of the support bars enables the fixture to be readily and simply adapted for on-site installation not only to fit within the flanged aperture of the T bar arrangement shown in FIG. 2, but also to fit the smaller aperture of a flush ceiling light fixture, such as shown in FIG. 3, as will hereinafter be more fully described. This adaptability of the fixture embodying this invention is provided not only by the proper dimensional relationship heretofore described, but also by the selection of the material of which the fixture is formed. In this connection, it is significant that the fixture is thermoformed of a flexibly resilient synthetic plastic resin, preferably translucent. The resin used is selected so that the rim portion 9 of the fixture is severable using an ordinary cutting implement, such as a pen knife or razor blade, so that the width of the web may be changed as necessary for on-site installation. Suitable material for forming the fixture embodying this invention is a synthetic plastic, such as an acrylic or polystyrene resin.

The fixture 6 is preferably thermoformed from a thermoplastic sheet material which may be about $\frac{1}{4}$ inch in thickness before forming. Vacuum forming is a suitable technique for forming the integral trough-shaped fixture emboding this invention. Using a suitable thermoformable resin, a highly beneficial combination of properties can be obtained. Included among these properties is flexural deformability whereby the unitary fixture can be easily flexed by manual pressure, such as when the fixture is being installed in a ceiling opening. In such installation, the opposite side walls 10 and 12 of the integral diffuser may be flexed inwardly, one toward the other, and while so held, the fixture may be inserted into the ceiling opening by tilting the fixture as necessary. In this deformed shape, once inserted through the opening, the fixture is allowed to flex back to its normal shape and then lowered to bring its rim portion 9 into supportive engagement on the flange portion of the ceiling support bars.

In FIG. 2, the fixture is shown installed in a suspended ceiling wherein the light fixture 28 is shown supported by support members 30 independently of the suspended ceiling installation. The fixture includes one or more tubular light sources 32, such as fluorescent light tubes. Normally, with such installations, some type of light diffuser or lens (not shown) is mounted on the flange of T support bars below the light source 32. The lens or diffuser is generally flush with the plane of the suspended ceiling and in some installations the diffuser may extend somewhat below the plane of the ceiling. When it is desired to install a combination diffuser and visual display fixture of the type embodying this invention, it is only necessary to remove the conventional light diffuser and substitute therefor the unitary fixture embodying my invention. In some ceiling installations the light fixtures as shown at 35 in FIG. 3, which are used with the suspended ceiling, are supported by the ceiling support bars. Such fixtures generally include a rim or frame 36 which has an inwardly extending flange to support a generally planar diffuser or lens normally provided with such lighting fixtures. The frame 36 is disposed inwardly of the housing 37 of the fixture and it will be seen that the frame is disposed inside the support bars. The fixture shown in FIG. 3 includes tubular light sources 38 of the same type used in the FIG. 2 installations. In this installation the standard diffuser is removed and the flange of the diffuser-display unit rim cut to fit within the frame of the light fixture 35, as shown in FIG. 3.

The utility fixture of my invention is uniquely adapted as not only a light diffuser, but also for the illuminated visual display for advertising and other product information. Since the display unit is mounted directly below an environmental tubular light source, the illumination is diffused through the translucent body into the surrounding area and will highlight any display applied to the wall portions of the display unit. In this connection, the information indicia, which may take the form of product name, trademark, symbol, emblem, or a transparency applied onto the inner or outer surface of the fixture, will provide maximum visual impact to a customer in the surrounding area. The indicia may be applied in any convenient manner to the fixture, including embossing the display during thermoforming of the unit itself. The display may also be suitable colored by well known techniques to further highlight the display. Also, a transparency may be applied using suitable bonding techniques. Generally, indicia, such as shown at 40 in FIG. 1, is opaque or relatively less translucent and usually a different color than the remaining surface of the fixture. In this way, maximum contrast is obtained to visually set off and highlight the display information.

As previously indicated, the side wall portions of the fixture embodying my invention are inclined or tilted at a substantial angle from the vertical so that the light emanating from the tubular light source will strike the inner walls of the unit at a relatively small angle of incidence. As a consequence, the diffuser provides for excellent light transmission through its translucent body into the surrounding area. Moreover, the display information is also highly illuminated and easily seen from eye level by a viewer in the surrounding area.

The light thus transmitted through the translucent diffuser provides environmental lighting substantially undiminished relative to the lighting provided by conventional type ceiling light fixtures, despite the fact that the same fixture serves the dual purpose of an environmental display for advertising or product location.

Having thus described my invention, what is claimed is:

1. In combination with a suspended ceiling having generally rectangular ceiling tiles supported on a framework of mutually perpendicular support bars having a horizontal flange portion, one or more light sources disposed above the plane of the support bars at one or more spaced locations, at least one of said ceiling tiles below said light sources being removed for environmental illumination of the area in which the suspended ceiling is located, a visual display and a light diffuser for said area comprising an integral hollow body of translucent sheet material, said body having an upward opening, an outwardly extending annular rim portion dimensioned to supportively engage said support bars arranged about the periphery of one of said light sources, said body with the exception of said upward opening being continuous and wholly enclosing the illumination from said light source, said body diffusing said illumination and having a visual display thereon which is illuminated by said light source, said body is a thermoformed synthetic plastic material which is resiliently flexible enabling substantial flexure of said body and in which said rim portion is severable to reduce its width, said translucent body includes side wall portions which extend downwardly a substantial distance from said rim portion one of said side wall portions being inclined toward the other, said visual display being disposed on at least one of said side wall portions, said rim portion before being severed is of a width substantially greater than the horizontal flange portion of the support bars of said suspended ceiling.

* * * * *